US005506092A

United States Patent [19]

Ishikawa et al.

[11] Patent Number: 5,506,092

[45] Date of Patent: Apr. 9, 1996

[54] METHOD OF PROCESSING BLACK AND WHITE SILVER HALIDE PHOTOGRAPHIC COMPOSITIONS WITH A DEVELOPER CONTAINING AN ANTI SLUDGANT

[75] Inventors: Wataru Ishikawa; Takeshi Sampei, both of Tokyo, Japan

[73] Assignee: Konica Corporation, Japan

[21] Appl. No.: 347,051

[22] Filed: Nov. 30, 1994

[30] Foreign Application Priority Data

Dec. 6, 1993 [JP] Japan ..... 5-305470

[51] Int. Cl.[6] ..... F03C 5/18; G03C 5/26; G03C 1/06

[52] U.S. Cl. ..... 430/399; 430/264; 430/445; 430/487; 430/488; 430/490; 430/491; 430/493; 430/963

[58] Field of Search ..... 430/488, 487, 430/490, 491, 493, 963, 445, 264, 399

[56] References Cited

U.S. PATENT DOCUMENTS

| | | | |
|---|---|---|---|
| 2,384,592 | 9/1945 | Bean | 95/88 |
| 2,606,118 | 8/1952 | Rogers | 95/88 |
| 3,432,298 | 3/1969 | Rintelen et al. | 430/488 |
| 4,310,622 | 1/1982 | Onda et al. | 430/488 |
| 4,833,068 | 5/1989 | Ohki et al. | 430/490 |
| 4,839,263 | 6/1989 | Miyoshi et al. | 430/490 |
| 4,882,261 | 11/1989 | Kojima et al. | 430/487 |
| 5,385,811 | 1/1995 | Hirano | 430/488 |

FOREIGN PATENT DOCUMENTS

| | | | |
|---|---|---|---|
| 0223883 | 6/1987 | European Pat. Off. | 430/493 |
| 0556323 | 10/1993 | European Pat. Off. | 430/488 |
| 0591934 | 4/1994 | European Pat. Off. | 430/488 |
| 1447796 | 2/1969 | Germany | 430/490 |
| 63-26655 | 2/1988 | Japan | 430/490 |
| 3-55541 | 3/1991 | Japan | 430/488 |
| 3-132649 | 6/1991 | Japan | 430/488 |
| 4-11249 | 1/1992 | Japan | 430/488 |
| 4-186343 | 6/1992 | Japan | 430/490 |
| 4-299337 | 10/1992 | Japan | 430/488 |
| 4-299338 | 10/1992 | Japan | 430/488 |
| 4-333046 | 11/1992 | Japan | 430/488 |
| 6-59405 | 3/1994 | Japan | 430/488 |
| 6-118576 | 4/1994 | Japan | 430/488 |
| 6-123943 | 5/1994 | Japan | 430/488 |
| 940169 | 10/1963 | United Kingdom | 430/488 |

OTHER PUBLICATIONS

*Research Disclosure,* Nov. 1977, p. 80, No. 16381, by G. I. P. Levenson et al.

*Primary Examiner*—Charles L. Bowers, Jr.
*Assistant Examiner*—J. Pasterczyk
*Attorney, Agent, or Firm*—Jordan B. Bierman; Bierman and Muserlian

[57] ABSTRACT

A method of developing with developer an exposed black and white silver halide photographic light-sensitive material is disclosed, the developer containing a compound represented by the following Formula (1a), (1b), (2) or (3) and a compound represented by the following Formula (4) or (5):

Formula (1a)

Formula (1b)

Formula (2)

Formula (3)

Formula (4)

Formula (5)

11 Claims, No Drawings

METHOD OF PROCESSING BLACK AND WHITE SILVER HALIDE PHOTOGRAPHIC COMPOSITIONS WITH A DEVELOPER CONTAINING AN ANTI SLUDGANT

FIELD OF THE INVENTION

The invention relates to a method of processing a black-and-white silver halide photographic light-sensitive material, and particularly to a method of processing, with a developer having a pH of not more than 10.4, a silver halide photographic light-sensitive material giving high sensitivity and high contrast and being free from silver sludge and black spots with less replenishing and rapid development.

BACKGROUND OF THE INVENTION

The method of processing a black-and-white silver halide photographic light-sensitive material comprises the four processes of developing, fixing, washing and drying after exposing. Since the development is conducted using an alkali developer containing a developing agent such as a dihydroxy benzene, the developer usually contains a sulfite for the purpose of preventing oxidation of the developing agent and improving storage stability of the developer. However, the sulfite has the ability of solubilizing silver salts and the silver salts dissolved out in the developer during the development of the silver halide photographic light-sensitive material is reduced to silver metal. The silver metal adheres to the surface of the developed silver halide photographic light-sensitive material, resulting in the occurrence of silver stain, so-called, silver sludge. When processing the silver halide photographic light-sensitive material containing a contrast-increasing agent such as a hydrazine derivative described in U.S. Pat. No. 4,975,354 and Japanese Patent O.P.I. Publication No. 63-29751, there occur problems that, in addition to silver stains, much minute spotting fog, so-called, black spots appear in unexposed portions.

Recently, less replenishment of the developer, which reduces photographic solution waste, is practiced in view of environmental concerns and rapid processing at a high temperature is conducted using an automatic developing apparatus for the purpose of improving processability. In such cases above, the occurrence of silver stain and black spots is a serious problem. In view of the above, there is a limitation to the increase of a sulfite to improve storage stability of the developer, and a method of obtaining high storage stability without the increase of the sulfite is required. Further, the study of a silver sludge preventing agent has been made, for example, an agent such as 1-phenyl-5-mercapotetrazole derivative is disclosed in U.S. Pat. No. 3,173,789. However, the use of such agents results in lowering the developing speed and the fixing speed due to the carry-over of developer to the fixer and a method of preventing silver sludge without adverse effects on developing or fixing is also required.

SUMMARY OF THE INVENTION

A first object of the invention is to provide a method of processing a silver halide photographic light-sensitive material, wherein the method prevents silver sludge without adverse effects on developing or fixing and gives a high storage stability which is attained even in less replenishment and in rapid processing. A second object of the invention is to provide a method of processing a silver halide photographic light-sensitive material, wherein the method gives a high sensitivity, a high contrast and no black spots even in less replenishment and in rapid processing.

DETAILED DESCRIPTION OF THE INVENTION

The above object of the invention can be attained by a method of processing an exposed silver halide photographic light-sensitive material comprising a support and provided thereon, a silver halide emulsion layer and a hydrophilic colloid layer other than the silver halide emulsion layer using an automatic developing apparatus, comprising the steps of:

a) developing the exposed material with developer, the developer being replenished with developer replenisher;

b) fixing the developed material with fixer;

c) washing the fixed material; and d) drying the washed material, wherein the developer contains a compound represented by the following Formula (1a), (1b), (2) or (3) and a compound represented by the following Formula (4) or (5):

Formula (1a)

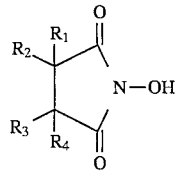

Formula (1b)

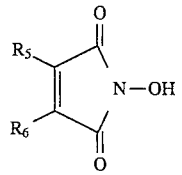

wherein $R_1$ through $R_6$ independently represent a hydrogen atom, a substituted or unsubstituted alkyl group, a substituted or unsubstituted aryl group, a substituted or unsubstituted allyl group, a hydroxy group, a carboxy group, a sulfo group, a nitro group, a cyano group, a halogen atom, a hydroxyamino group, a substituted or unsubstituted alkoxy group, a substituted or unsubstituted amino group or a substituted or unsubstituted carbamoyl group, provided that $R_2$ and $R_3$, and $R_5$ and $R_6$ may combine each other to form a saturated or unsaturated ring, Formula (2)

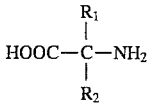

wherein $R_1$ and $R_2$ independently represent a hydrogen atom, a substituted or unsubstituted alkyl group, a substituted or unsubstituted allyl group, a substituted or unsubstituted aryl group, a carboxy group, a hydroxy group, a sulfo group, a nitro group, a cyano group, a halogen atom, a hydroxyamino group, a substituted or unsubstituted alkoxy group, a substituted or unsubstituted amino group or a substituted or unsubstituted carbamoyl group, Formula (3)

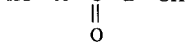

wherein A and B independently represent a substituted or unsubstituted alkylene group, a substituted or unsubstituted alkenylene group, a substituted or unsubstituted alkyleneoxy group, a substituted or unsubstituted arylene group, a sulfonyl group, —R—C(O)— or —R—NH— wherein R represents a substituted or unsubstituted alkylene, alkenylene or arylene group, provided that A and B may be the same or different, Formula (4)

Z—SM wherein Z represents an alkyl, aromatic or heterocyclic group, each of which may have at least one selected from the group consisting of a hydroxy group, an $—SO_3M^1$ group, a $—COOM^1$ group (wherein $M^1$ represents a hydrogen atom, an alkali-metal atom or a substituted or unsubstituted ammonium), a substituted or unsubstituted amino group and a substituted or unsubstituted ammonio group, or a substituent having at least one selected from the group consisting of a hydroxy group, an $—SO_3M^1$ group, a $—COOM^1$ group (wherein $M^1$ represents a hydrogen atom, an alkali-metal atom or a substituted or unsubstituted ammonium), a substituted or unsubstituted amino group and a substituted or unsubstituted ammonio group; and M represents a hydrogen atom, an alkali-metal atom or a substituted or unsubstituted ammonium, $$\begin{array}{l}(S)_n—A_1(—B_1)_{m_1}\\ \quad\;\;|\\ \quad\;\;S—A_2(—B_2)_{m_2}\end{array} \qquad \text{Formula (5)}$$

wherein $A_1$ and $A_2$ independently represent a substituted or unsubstituted alkylene, cycloalkylene, aralkylene, arylene or divalent 5- or 6-membered heterocyclic group; $m_1$ and $m_2$ independently represent an integer of 1, 2 or 3; n is 1 or 2; and $B_1$ and $B_2$ independently represent —COOM, $—SO_3M'$, —CON(X)(Y), —S—Z' or $—SO_2N(X)(Y)$ wherein X and Y independently represent a hydrogen atom or an alkyl group having 1–8 carbon atoms or an aryl group each of which may have a hydroxyl group, a carboxyl group or a sulfonic acid group, M and M' independently represent a hydrogen atom or an alkali metal atom and Z' represents the same as X or Y, provided that Z' is not a hydrogen atom.

In Formula (1a) or (1b) $R_1$ through $R_6$ independently represent a hydrogen atom, a substituted or unsubstituted alkyl group having 1 to 10 carbon atoms (a methyl, ethyl or propyl group), a substituted or unsubstituted aryl group having 5 to 12 carbon atoms (a phenyl or naphthyl group), an allyl group, a hydroxy group, a carboxy group, a sulfo group, a nitro group, a cyano group, a halogen atom (a chlorine or bromine atom), a hydroxyamino group, a substituted or unsubstituted alkoxy group (a methoxy or ethoxy group, each of which may preferably a substituent having 1–10 carbon atoms), a substituted or unsubstituted amino group or a substituted or unsubstituted carbamoyl group, provided that $R_2$ and $R_3$, and $R_5$ and $R_6$ may combine each other to form a saturated or unsaturated ring.

The amount used of the compounds of the invention is 1 to 50 g per 1 liter of developer, and preferably 4 to 20 g per 1 liter of developer. The compounds of the invention are well known and available on the market.

Next, the exemplified compound of Formula (1) through (3) will be shown. However, the invention is not limited thereto.

Exemplified compounds of Formula (1)

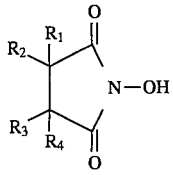

| | $R_1$ | $R_2$ | $R_3$ | $R_4$ |
|---|---|---|---|---|
| 1-1 | H | H | H | H |
| 1-2 | −OH | H | H | H |
| 1-3 | −OH | −OH | H | H |
| 1-4 | $-CH_3$ | H | H | H |
| 1-5 | $-SO_3H$ | H | H | H |
| 1-6 | −COOH | H | H | H |
| 1-7 | $-CH_2CH_2OH$ | H | H | H |

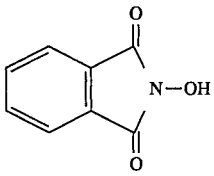

1-8

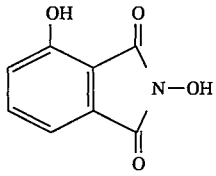

1-9

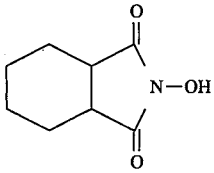

1-10

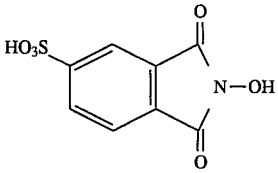

1-11

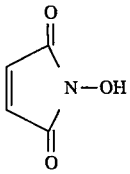

1-12

Exemplified compounds of Formula (2)

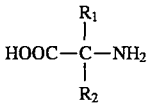

| | $R_1$ | $R_2$ |
|---|---|---|
| 2-1 | H | $-CH_2CH_3$ |
| 2-2 | H | $-CH_2CH_2OH$ |
| 2-3 | H | $-(CH_2)_3-COOH$ |
| 2-4 | $CH_3$ | $-CH_2CH_2OH$ |

-continued

Exemplified compounds of Formula (2)

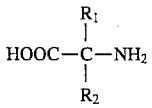

| | $R_1$ | $R_2$ |
|---|---|---|
| 2-5 | H | 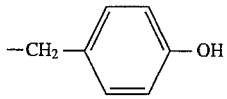 |
| 2-6 | H | $-CH_2-CH=CHCH_3$ |
| 2-7 | $NH_2$ | H |
| 2-8 | H | $-(CH_2)_4-NH_2$ |
| 2-9 | H | 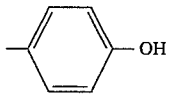 |
| 2-10 | H | 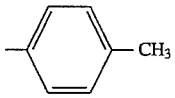 |

Exemplified compounds of Formula (3)

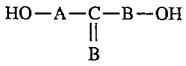

| | A | B |
|---|---|---|
| 3-1 | $-CH_2-$ | $-CH_2-$ |
| 3-2 | $-CH_2-$ | $-(CH_2)_3-$ |
| 3-3 | $-OCH_2-$ | $-CH_2-$ |
| 3-4 | 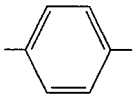 | $-CH_2-$ |
| 3-5 | $-CH_2-CH=CH-CH_2-$ | $-CH_2-$ |
| 3-6 | $-C(=O)-CH_2CH_2-$ | $-CH_2CH_2-C(=O)-$ |
| 3-7 | $-CH_2-$ | $-CH_2-CH(OH)-CH_2-$ |
| 3-8 | $-CH_2-C(=O)-$ | $-CH_2-$ |
| 3-9 | $-C(=O)-CH_2-$ | $-CH_2-$ |
| 3-10 | $-CH_2-N(H)-$ | $-CH_2-$ |
| 3-11 | $-CH_2CH_2-O-$ | $-CH_2-$ |

Now, the compound represented by Formula (4) will be detailed below.

In the formula, Z represents an alkyl, aromatic or heterocyclic group, each of which may have at least one selected from the group consisting of a hydroxy group, an $-SO_3M^1$ group, a $-COOM^1$ group, (wherein $M^1$ represents a hydrogen atom, an alkali-metal atom or a substituted or unsubstituted ammonium), a substituted or unsubstituted amino group and a substituted or unsubstituted ammonio group, or a substituent having at least one selected from the group; and M represents a hydrogen atom, an alkali-metal atom or a substituted or unsubstituted ammonium.

The substituent having at least one group selected from the group in above, is preferably a substituted or unsubstituted alkylthio group, a substituted or unsubstituted alkylamido group, a substituted or unsubstituted alkylcarbamoyl group, a substituted or unsubstituted alkylsulfonamido group or a substituted or unsubstituted alkylsulfamoyl group, each of which has not more than 20 carbon atoms.

In Formula (4), the alkyl group represented by Z includes, preferably, an alkyl group having 1 to 30 carbon atoms and, particularly, a straight-chained, branched or cyclic alkyl group having 2 to 20 carbon atoms, which may have other substituents than the above-mentioned substituent. The aromatic group represented by Z includes, preferably, a monocyclic or condensed ring having 6 to 32 carbon atoms, which may have other substituents than the above-mentioned substituent. The heterocyclic group represented by Z is preferably a 5- or 6-membered ring having 1 to 6 hetero atoms selected from the group consisting of nitrogen, oxygen and sulfur in one of the ring thereof which is a monocyclic or condensed ring having 1 to 32 carbon atoms. The heterocyclic group may also have other substituents than the above-mentioned substituents.

In Formula (4), the ammonio group preferably has, as a substituent, a substituted or unsubstituted straight-chained, branched or cyclic alkyl group such as a methyl group, an ethyl group, a benzyl group, an ethoxypropyl group or a cyclohexyl group, or a substituted or unsubstituted phenyl or naphthyl group, each having not more than 20 carbon atoms.

Among the compounds represented by Formula (4), the preferable ones include, for example, those represented by the following Formulas (4a), (4b) and (4c).

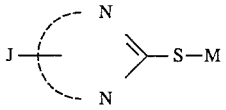

wherein T represents an atomic group necessary to form a 5- or 6-membered heterocyclic ring which may be monocyclic or polycyclic; J represents a hydroxy group, $-SO_3M^1$, $-COOM^1$ (in which $M^1$ is synonymous with $M^1$ denoted in Formula (4)), a substituted or unsubstituted amino group or a substituted or unsubstituted ammonio group, an alkylthio group having 1 to 19 carbon atoms which is substituted by one or more amino or ammonio group, an alkylamido group having 2 to 18 carbon atoms, an alkylcarbamoyl group having 2 to 18 carbon atoms, an alkyl group having 1 to 19 carbon atoms, or an aromatic group having 6 to 31 carbon atoms; and M is synonymous with M denoted in Formula (4).

Formula (4b)

$A^1-ALK-SM^2$ wherein $A^1$ represents a hydroxy group, $-SO_3M^1$, $-COOM^1$ (in which $M^1$ is synonymous with $M^1$ denoted in Formula (4)), $-N(R^7)_2$ group (in which $R^7$ represents a substituted or unsubstituted alkyl group having 1 to 5 carbon atoms, provided that the $R^7$ groups may be coupled to each other to form a ring); ALK represents a substituted or unsubstituted alkylene group having 2 to 12 carbon atoms; and $M^2$ represents a hydrogen atom or

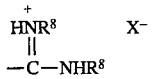

wherein $R^8$ represents a hydrogen atom, a substituted or unsubstituted alkyl group having 1 to 5 carbon atoms or a substituted or unsubstituted phenyl group having not more than 10 carbon atoms, and $X^-$ represents a halide ion or a sulfonic acid ion.

Formula (4c)

$A^1$—Ar—SM wherein $A^1$ is synonymous with $A^1$ denoted in Formula (4b), Ar represents an aryl group which may be substituted, and M is synonymous with M denoted in Formula (4).

The typical examples of the compounds represented by Formula (4) will be given below. However, the compounds represented thereby shall not be limited thereto.

(4-1)

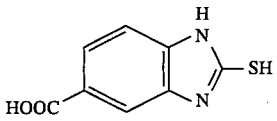

(4-2)

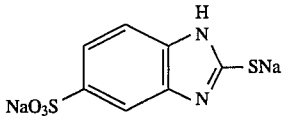

(4-3)

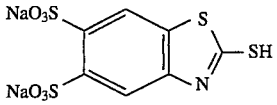

(4-4)

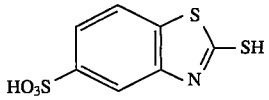

(4-5)

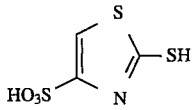

(4-6)

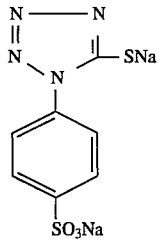

(4-7)

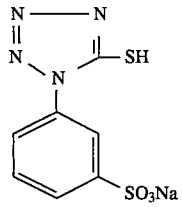

-continued (4-8)

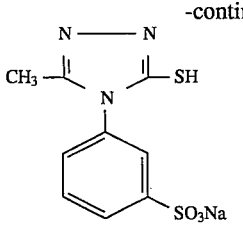

(4-9)

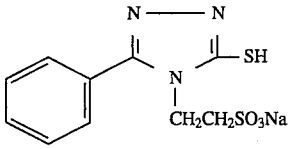

(4-10)

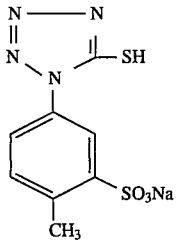

(4-11)

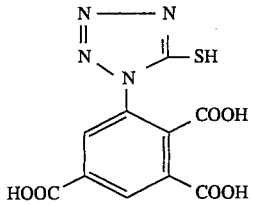

(4-12)

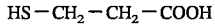

(4-13)

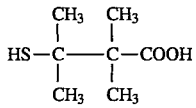

(4-14)

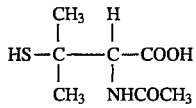

(4-15)

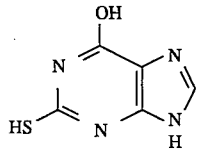

(4-16)

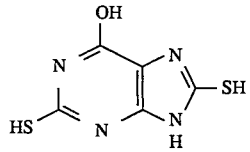

-continued (4-17)

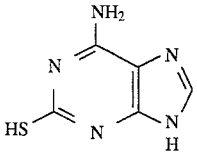

(4-18)

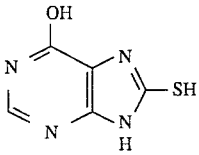

(4-19)

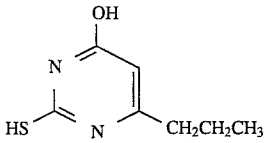

(4-20)

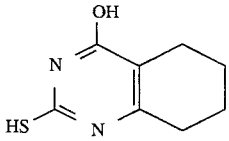

(4-21)

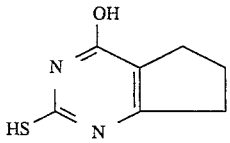

(4-22)

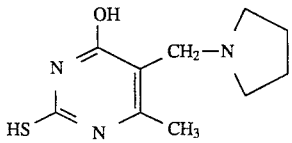

(4-23)

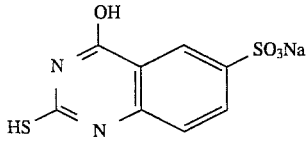

(4-24)

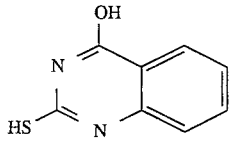

(4-25)

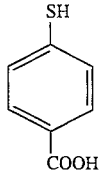

(4-26)

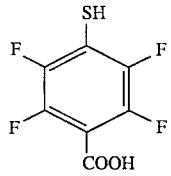

-continued (4-27)

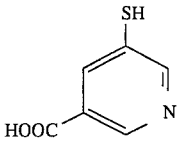

(4-28)

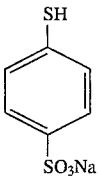

Now, Formula (5) will be detailed below.

Among the compounds represented by Formula (5), the compounds represented by Formula (5a) or (5b) are preferable.

Formula (5a)

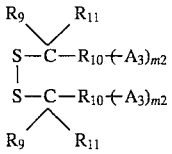

Formula (5b)

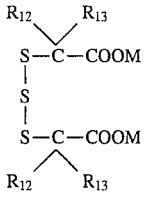

In Formula (5a), $R_9$ and $R_{11}$ represent each a hydrogen atom, a substituted or unsubstituted alkyl group having 1 to 6 carbon atoms, a substituted or unsubstituted alkenyl group, a substituted or unsubstituted aralkyl group, a substituted or unsubstituted cycloalkyl group, a substituted or unsubstituted phenyl group, a substituted or unsubstituted 5- or 6-membered heterocyclic ring containing 1 to 3 nitrogen atoms, one oxygen atom or one sulfur atom, or a carboxylic acid group; $R_{10}$ represents a direct bond, a substituted or unsubstituted alkylene, alkylidene, phenylene or aralkylene group or —$CONHCH_2$—; $A_3$ represents —COOM or —$SO_3M$ (in which M is synonymous with $M^1$ denoted in Formula (4); and $m_2$ is an integer of 1 or 2.

In Formula (5b), $R_{12}$ and $R_{13}$ represent each a hydrogen atom or a methyl group; and M represents, preferably, a hydrogen atom or an alkali-metal atom (such as Na or K)

Among the compounds represented by Formula (5a), the compound represented by the following Formula (5a-1) is further preferable.

Formula (5a-1)

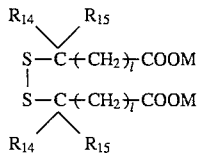

In Formula (5a-1), $R_{14}$ and $R_{15}$ represent each a hydrogen atom, a substituted or unsubstituted alkyl group (such as —$CH_3$, —$C_2H_5$, —$CH_2OH$ or —$CH_2COOH$), a substituted or unsubstituted cycloalkyl group (such as a cyclopentyl group or a cyclohexyl group), a substituted or unsubstituted phenyl group (such as a phenyl group, a tolyl group, a p-chlorophenyl group, an aminophenyl group, a p-sulfophenyl group or a p-sulfonamidophenyl group), a substituted or unsubstituted 5- or 6-membered heterocyclic ring containing 1 to 3 nitrogen atoms, one oxygen atom or one sulfur atom (such as a furyl group or a thienyl group), or a carboxyl group, provided that $R_{14}$ and $R_{15}$ may be the same with or the different from each other); and 1 is an integer of 1, 2, 3 or 4.

The typical examples of the compounds represented by Formula (5) will be given below.

$$HOOC-H_2C-S-S-CH_2-COOH \quad (5\text{-}1)$$

$$\begin{array}{l} H_3C-HC-S-S-CH-CH_3 \\ \quad\quad\;\; | \quad\quad\quad\quad\quad | \\ \quad\quad H_2C-H_2C \quad\quad CH_2-CH_2 \\ \quad\quad\quad\;\; | \quad\quad\quad\quad\quad | \\ \quad\quad NaO_3S \quad\quad\quad\quad SO_3Na \end{array} \quad (5\text{-}2)$$

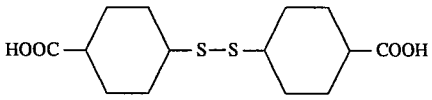
(5-3)

Thiolactic acid (5-4)

α-mercaptoisolactic acid (5-5)

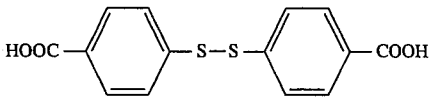
(5-6)

$$HOOC(CH_2)_2-S-S-(CH_2)_2COOH \quad (5\text{-}7)$$

$$\begin{array}{l} \quad CH_3 \quad\quad\quad CH_3 \\ \quad\;\; | \quad\quad\quad\quad | \\ HOOC-C-S-S-C-COOH \\ \quad\;\; | \quad\quad\quad\quad | \\ \quad CH_3 \quad\quad\quad CH_3 \end{array} \quad (5\text{-}8)$$

$$HOOC-CH_2-CH-S-S-CH-CH_2-COOH \quad (5\text{-}9)$$
$$\quad\quad\quad\quad | \quad\quad\quad\quad | \quad\quad\quad\quad\ having 1 to 40 carbon atoms), a hydroxy group or a phosphoamide group (preferably having 1 to 40 carbon atoms).

The group represented by A preferably has at least one of a non-diffusible group and a group for promoting silver halide adsorption. The non-diffusible group is preferably a ballast group which is conventionally used in immobile photographic additives such as couplers, and the ballast group includes an alkyl, alkenyl, alkinyl or alkoxy group having not less than 8 carbon atoms or a phenyl, phenoxy or alkylphenoxy group, which is relatively inactive to photographic properties.

The group for promoting silver halide adsorption includes a thiourea, thiourethane, mercapto, thioether, thion, heterocyclic, thioamidoheterocyclic or mercaptoheterocyclic group or an adsorption group described in Japanese Patent O.P.I. Publication No. 64-90439/1989.

The example of B includes an acyl group (for example, formyl, acetyl, propionyl, trifluoroacetyl, methoxyacetyl, phenoxyacetyl, methylthioacetyl, chloroacetyl, benzoyl, 2-hydroxymethylbenzoyl, 4-chlorobenzoyl), an alkylsulfonyl group (for example, methanesulfonyl, chloroethanesulfonyl), an arylsulfonyl group (for example, benzenesulfonyl), an alkylsulfinyl group (for example, methanesulfinyl), an arylsulfinyl group (for example, benzenesulfinyl), a carbamoyl group (for example, methylcarbamoyl, phenylcarbamoyl), an alkoxycarbonyl group (for example, methoxycarbonyl, methoxyethoxycarbonyl), an aryloxycarbonyl group (for example, phenyloxycarbonyl), a sulfamoyl group (for example, dimethylsulfamoyl), a sulfinamoyl group (for example, methylsulfinamoyl), an alkoxysulfonyl group (for example, methoxysulfonyl), a thioacyl group (for example, methylthiocarbonyl), a thiocarbamoyl group (for example, methylthiocarbamoyl)

$$-\overset{\overset{\displaystyle O}{\|}}{C}-\overset{\overset{\displaystyle O}{\|}}{C}-R_{16}$$

(wherein $R_{16}$ represents a substituent), or a heterocyclic group (for example, pyridinyl, pyridinium).

B in Formula (H) may form $-N{=}C(R_{17})(R_{18})$ together with A2 and a nitrogen atom, wherein $R_{17}$ represents an alkyl group, an aryl group or a heterocyclic group, and $R_{18}$ represents a hydrogen atom, an alkyl group, an aryl group or a heterocyclic group.

B is preferably an acyl group or $$-\overset{\overset{\displaystyle O}{\|}}{C}-\overset{\overset{\displaystyle O}{\|}}{C}-R_{16}$$

(wherein $R_{16}$ represents a substituent).

$A_1$ and $A_2$ represent both hydrogen atoms or one of $A_1$ and $A_2$ represents a hydrogen atom and the other represents an acyl group (acetyl, trifluoroacetyl, benzoyl), a sulfonyl group (methanesulfonyl, toluenesulfonyl) or $$-\overset{\overset{\displaystyle O}{\|}}{C}-\overset{\overset{\displaystyle O}{\|}}{C}-R_{16}$$

(ethoxalyl).

Of the hydrazine compounds in the invention, the compound represented by the following Formula (Ha) is preferable:

$$R_{19}-\overset{\overset{\displaystyle A_1}{|}}{N}-\overset{\overset{\displaystyle A_2}{|}}{N}-\overset{\overset{\displaystyle O}{\|}}{C}-\overset{\overset{\displaystyle O}{\|}}{C}-R_{20} \qquad \text{Formula (Ha)}$$

wherein $R_{19}$ represents an aryl group or a heterocyclic group.

The aryl group represented by $R_{19}$ is preferably a single or condensed ring group, for example, a benzene ring group or a naphthalene ring group.

The heterocyclic group represented by $R_{19}$ is preferably a single or condensed ring group containing a 5- or 6-membered heterocycle having one hetero atom selected from a nitrogen, sulfur and oxygen atom, such as a pyridine ring, a quinoline ring, a pyrimidine ring, a thiophene ring, a furan ring, a thiazole ring or a benzothiazole ring.

$R_{19}$ is preferably a substituted or unsubstituted aryl group. The substituent is the same as that of A in Formula (H). $R_{19}$ is preferably a group having at least one sulfo group when a developer having pH of not more than 11.2 is used for high contrast.

$A_1$ and $A_2$ are the same as $A_1$ and $A_2$ of Formula (H), respectively, and are preferably simultaneously hydrogen atoms.

$R_{20}$ represents $$-N\begin{matrix} R_{21} \\ R_{22} \end{matrix} \quad \text{group} \quad \text{or} \quad -OR_{23} \quad \text{group}$$

wherein $R_{21}$ and $R_{22}$ independently represent a hydrogen atom, an alkyl group (methyl, ethyl or benzyl), an alkenyl group (allyl, butenyl), an alkinyl group (propagyl, butinyl), an aryl group phenyl, naphthyl), a heterocyclic group (2,2,6,6-tetramethylpiperidinyl, N-benzylpiperidinyl, quinolidinyl, N,N'-diethylpyrazolidinyl, N-benzylpyrrolidinyl, pyridyl), an amino group (amino, methylamino, dimethylamino, dibenzylamino), a hydroxy group, an alkoxy group (methoxy, ethoxy), an alkenyloxy group (allyloxy), an alkinyloxy group (propagyloxy), an aryloxy group (phenoxy) or a heterocyclic group (pyridyl), provided that $R_{21}$ and $R_{22}$ may combine each other with a nitrogen atom to form a ring (piperidine, morpholine), and $R_{23}$ represents a hydrogen atom, an alkyl group (methyl, ethyl, methoxyethyl or hydroxyethyl), an alkenyl group (allyl, butenyl), an alkinyl group (propagyl, butinyl), an aryl group phenyl, naphthyl), or a heterocyclic group (2,2,6,6-tetramethylpiperidinyl, N-methylpiperidinyl, pyridyl).

The Exemplified compounds represented by Formulas (H) and (Ha) will be shown below, but the invention is not limited thereto.

H-1
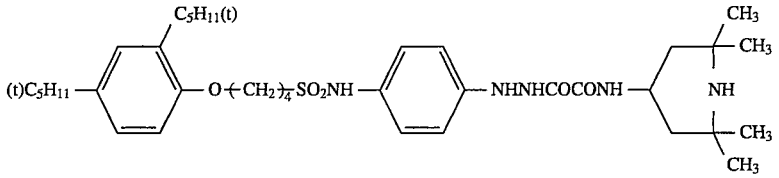
H-2
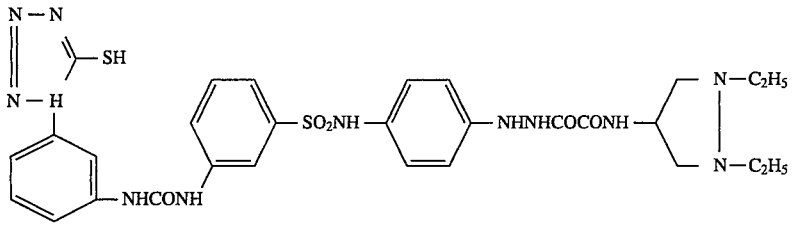
H-3
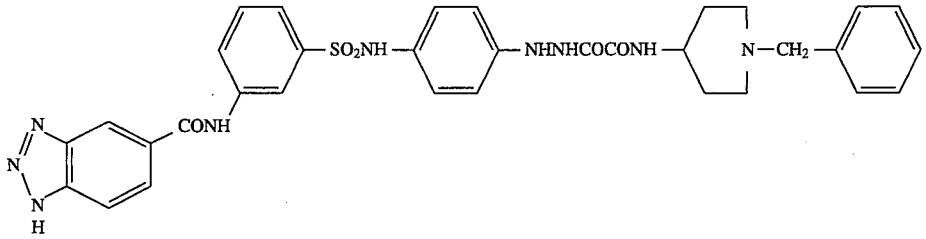
H-4
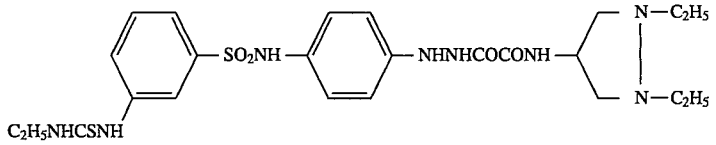
H-5
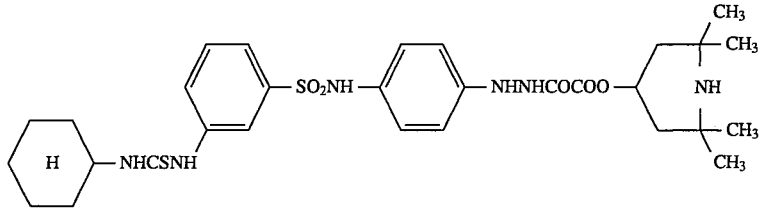
H-6
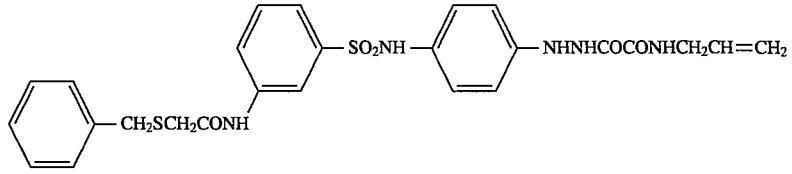
H-7
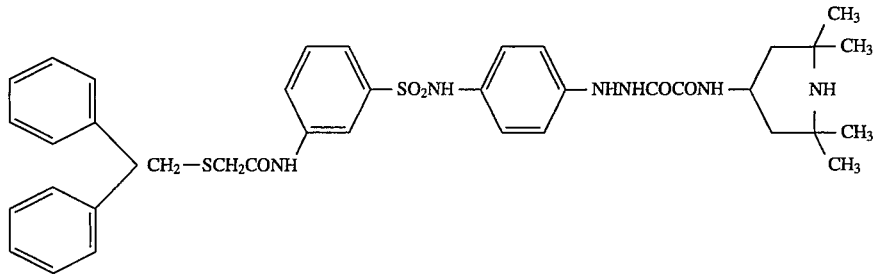

-continued
H-8
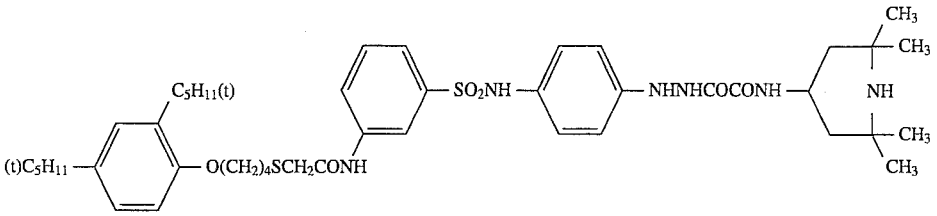
H-9
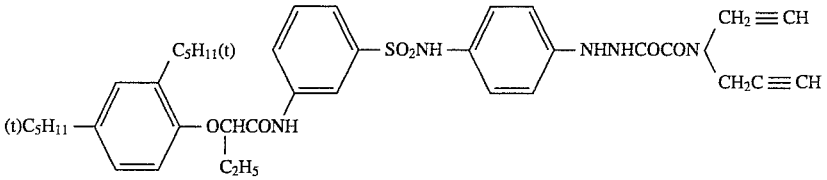
H-10
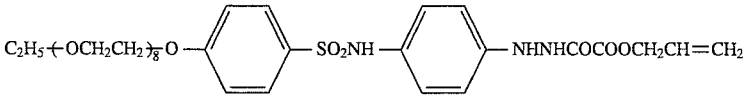
H-11
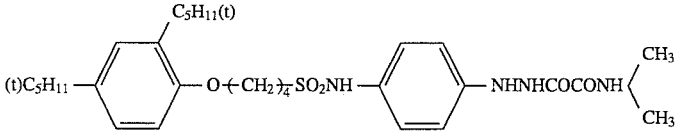
H-12
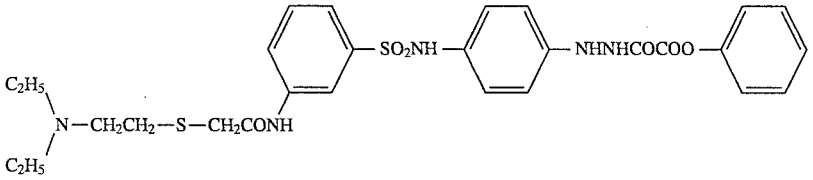
H-13
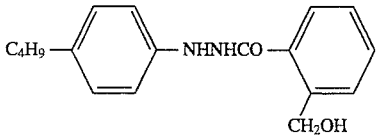
H-14
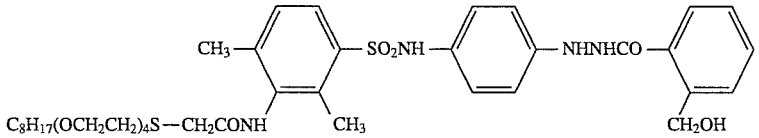
H-15
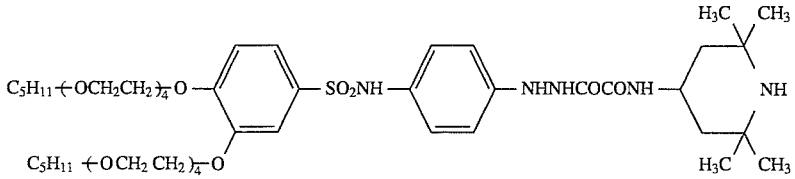
H-16
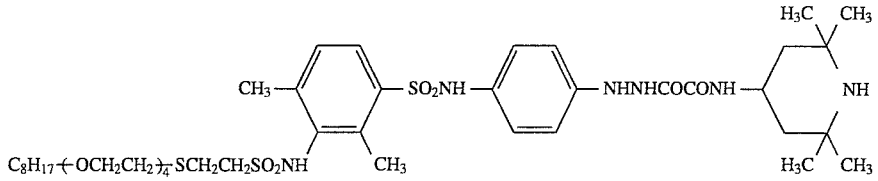

-continued

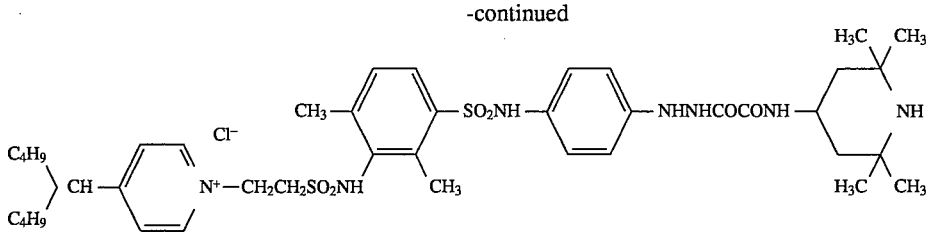

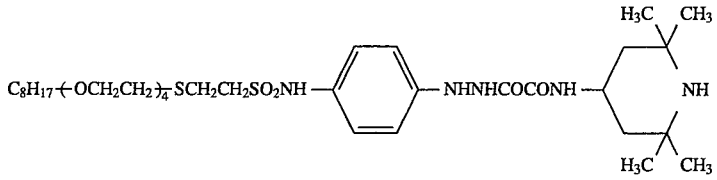

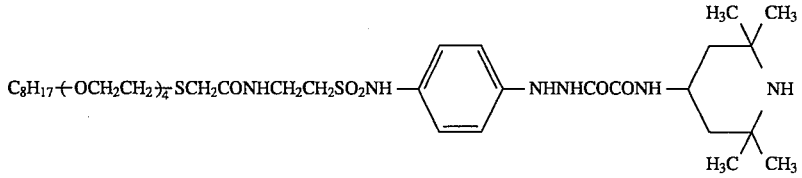

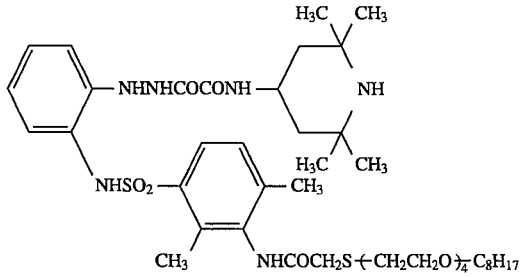

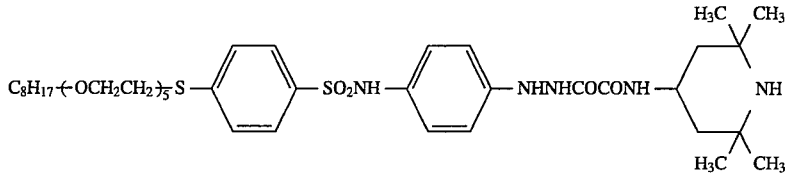

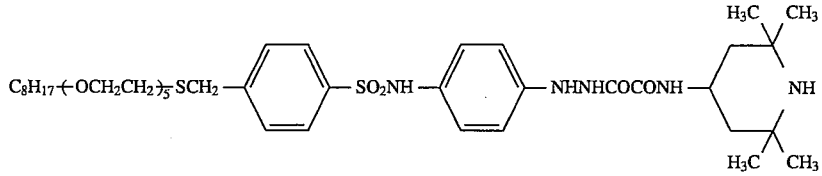

Besides the above compounds, the typical compounds include compounds H-1 through H-75 disclosed on pages 604(4) to 607(7) of Japanese Patent O.P.I. Publication No. 4-98239. The synthetic method of a compound represented by Formula (H) is referred to in Japanese Patent O.P.I. Publication Nos. 62- 180361, 62-178246, 63-234245, 63-234246, 64-90439, 2-37, 2- 841, 2-947, 2-120736, 2-230233 and 3-125134, U.S. Pat. Nos. 4,686,167, 4,988,604 and 4,994,365, European Patent Nos. 253,665 and 333,435.

The content of the compound of the invention represented by Formula (H) is preferably $5\times10^{-7}$ to $5\times10^{-1}$ mol/mol of silver, and more preferably $5\times10^{-6}$ to $5\times10^{-2}$ mol/mol of silver.

In the invention the compound represented by Formula (H) is contained in the silver halide emulsion layer or its adjacent hydrophilic colloid layers other than the emulsion layer of a photographic light sensitive material. The compound is preferably contained in the silver halide emulsion layer.

The nuclear promoting agent used in the invention includes a compound represented by the following Formula (Na) or (Nb):

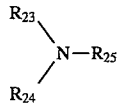

Formula (Na)

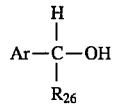

Formula (Nb)

In Formula (Na) $R_{23}$, $R_{24}$ and $R_{25}$ independently represent a hydrogen atom, a substituted or unsubstituted alkyl group, a substituted or unsubstituted alkenyl group, a substituted or unsubstituted alkinyl group or a substituted or unsubstituted aryl group, provided that $R_{23}$, $R_{24}$ and $R_{25}$ are not simultaneously hydrogen atoms and may form a ring together. The preferable agent is an aliphatic tertiary amines. These compounds preferably have in the molecules an anti-diffusible group or a silver halide adsorption group. The compounds having anti-diffusible property have preferably a molecular weight not less than 100, and more preferably a molecular weight not less than 300. The preferable adsorption group includes a heterocyclic, mercapto, thioether, thion or thiourea group.

The examples represented by Formula (Na) will be shown below.

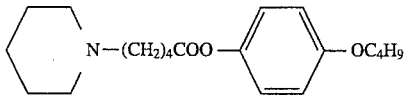
(Na-1)

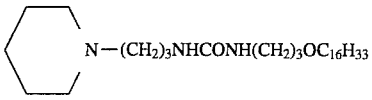
(Na-2)

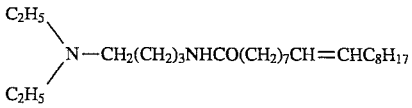
(Na-3)

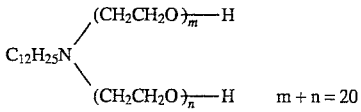
(Na-4)

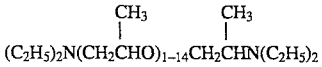
(Na-5)

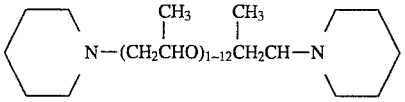
(Na-6)

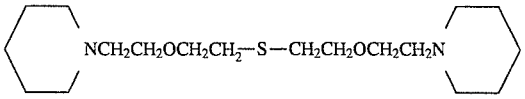
(Na-7)

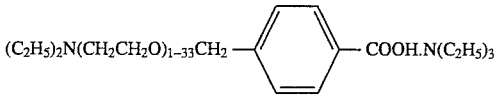
(Na-8)

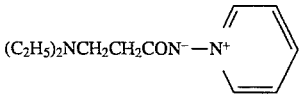
(Na-9)

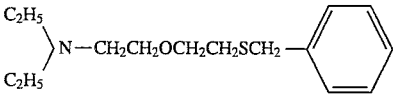
(Na-10)

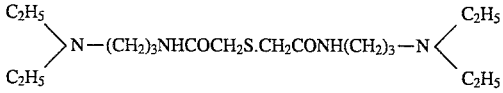
(Na-11)

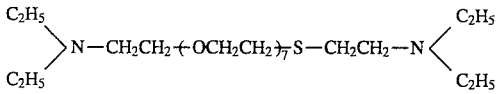
(Na-12)

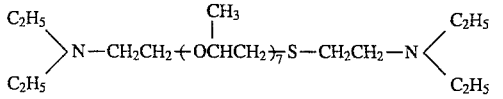
(Na-13)

-continued

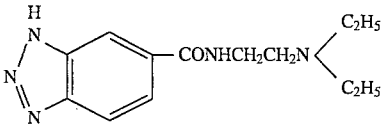
(Na-14)

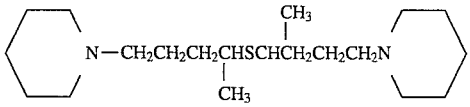
(Na-15)

In Formula (Nb) Ar represents a substituted or unsubstituted aryl or aromatic heterocyclic group; and $R_{26}$ represents a hydrogen atom, or an alkyl, alkenyl, alkinyl or aryl group, each of which may have a substituent, provided that Ar and $R_{26}$ may combine to form a ring. These compounds preferably have in the molecules an anti-diffusible group or a silver halide adsorption group. The compounds having anti-diffusible property have preferably a molecular weight not less than 120, and more preferably a molecular weight not less than 300.

The examples thereof will be shown below.

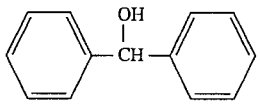
(Nb-1)

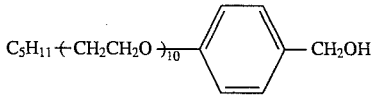
(Nb-2)

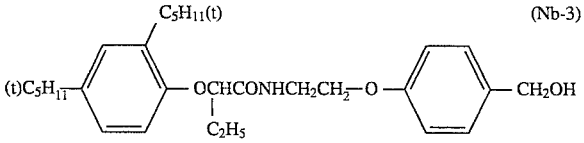
(Nb-3)

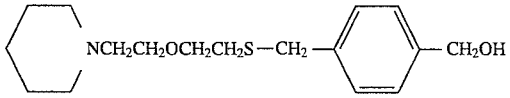
(Nb-4)

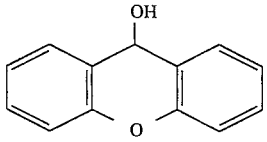
(Nb-5)

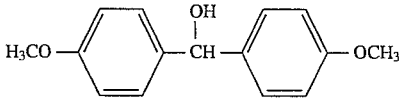
(Nb-6)

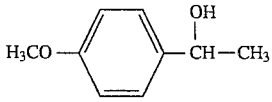
(Nb-7)

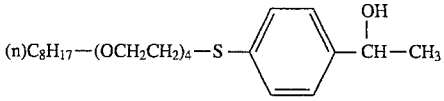
(Nb-8)

In the invention the compound represented by Formula (Na) or (Nb) is contained in the silver halide emulsion layer or hydrophilic colloid layers other than the emulsion layer of a photographic light sensitive material.

The silver halide photographic light-sensitive material in the invention preferably contains the compound represented by Formula (H) in the silver halide emulsion layer and the compound represented by Formula (Na) or (Nb) in the silver halide emulsion layer or its adjacent hydrophilic colloid layers.

In the black-and-white silver halide photographic light-sensitive material in the invention at least one conductive layer is preferably provided on a support. As a method of forming a conductive layer there is a method using of a water soluble conductive polymer, a hydrophobic polymer and a hardener or using metal oxides.

In a silver halide emulsion applicable to the invention, any silver halide applicable to a conventional silver halide emulsion can be used, such as silver bromide, silver iodobromide, silver iodochloride, silver chlorobromide, and silver chloride. Among these silver halides, it is preferable to use silver chlorobromide, silver iodide and silver iodobromide or silver iodochlorobromide each having a silver iodide content of not more than 2 mol %.

It is also preferable to use a monodisperse type grain having a variation coefficient of not higher than 15%. Such a variation coefficient is represented by (standard deviation of grain sizes)/(average grain size)×100.

A silver halide emulsion of the invention can be applied with various techniques and additives each well-known in the art.

For example, a silver halide photographic emulsion and a backing layer each applicable to the invention may also contain a variety of a chemical sensitizer, a color toner, a layer hardener, a surfactant, a thickener, a plasticizer, a lubricant, a development inhibitor, a UV absorbent, an anti-irradiation dye, a heavy metal and a matting agent, in various methods. A silver halide photographic emulsion and a backing layer each applicable to the invention may further contain a polymer latex.

The above-mentioned additives are further detailed in Research Disclosure, Vol. 176, Item/7643, (December, 1978) and, ibid., Vol. 187, Item/8716, (November, 1979). The pages and columns where the additives are described will collectively be shown below.

| Additive | RD/7643 | RD/8716 |
|---|---|---|
| 1. Chemical sensitizer | p.23 | p.648, r.col. |
| 2. Sensitivity increaser | | " |
| 3. Spectral sensitizer | pp.23~24 | p.648, r.col. |
| Supersensitizer | | p.649, r.col. |
| 4. Whitening agent | p.24 | |
| 5. Antifoggant & stabilizer | pp.24~25 | p.649, r.col. |
| 6. Light absorbent & filter dye | pp.25~26 | p.649, r.col. |
| UV absorbent | | p.650, l.col. |
| 7. Antistaining agent | p.25, r.col. | p.650, 1~r.col. |
| 8. Dye-image stabilizer | p.25 | |
| 9. Layer hardener | p.26 | p.651, l.col. |
| 10. Binder | p.26 | " |
| 11. Plasticizer & lubricant | p.27 | p.650, r.col. |
| 12. Coating aid & surfactant | pp.26~27 | " |
| 13. Antistatic agent | p.27 | " |

In a silver halide photographic light-sensitive material of the invention, a support applicable thereto include, for example those made of a polyester such as cellulose acetate, cellulose nitrate and polyethylene terephthalate, polyolefin such as polyethylene, polystyrene, baryta paper, polyolefin-coated paper, glass and metal. These supports may be subbed, if required.

The developing agent used in the developer of the invention includes dihydroxy benzenes (for example, hydroquinone, chlorehydroquinone, bromohydroquinone, 2'3-dichloro-hydroquinone, methylhydroquinone, isopropylhydroquinone, or 2,5-dimethylhydroquinone,), 3-pyrazolidone (for example, 1-phenyl-3-pyrazolidone, 1-phenyl- 4-methyl-3-pyrazolidone, 1-phenyl-4,4'-dimethyl-3-pyrazolidone, 1-phenyl-4-ethyl-3-pyrazolidone or 1-phenyl-5-methyl- 3-pyrazolidone), aminophenols (for example, o-aminophenol, p-aminophenol, N-methyl-p-aminophenol or 2,4-diaminophenol), pyrogallol, ascorbic acid, 1-aryl-3-pyrazolines (for example, 1-(p-hydroxyphenyl)-3-aminopyrazoline, 1-(p-methylaminophenyl)-3-aminopyrazoline, or 1-(p-amino-n-methlphenyl)-3-aminopyrazoline. They may be used singly or in combination. The combination of 3-pyrazolidones with dihydroxy benzenes or the combination of aminophenols with dihydroxy benzenes is preferable. The amount used of the developing agent is 0.01 to 1.4 mol per liter of developer.

The developer of the invention may further contain preservatives other than the compounds of the invention.

The sulfites or metabisulfites as the preservatives include sodium sulfite, potassium sulfite, ammonium sulfite and sodium metabisulfite. The amount used of the sulfite is not less than 0.25 mol per liter, and preferably not less than 0.4 mol per liter of developer. As silver sludge preventing agents, compounds as described in Japanese Patent Publication No. 62-4702 and Japanese Patent O.P.I. Publication Nos. 1- 319031, 3-51844, 4-26838 and 4-362942 can be added to developer in addition to the compounds of the invention. Besides the above compounds the developer optionally contains alkali agents (sodium hydroxide or potassium hydroxide), pH buffering agents (for example, carbonates, phosphates, borates, boric acid, acetic acid, citric acid or alkanol amines), auxiliary solubility agents (for example, polyethylene glycols or salts thereof or alkanol amines), sensitizing agents (for example, non-ionic surfactant including polyoxy ethylenes or quaternary ammonium salts), surfactants, anti-foggants (for example, halides such as potassium bromide and sodium bromide, nitro benzindazole, nitro benzimidazole, benzotriazoles, benzothiazoles, tetrazoles or thiazoles), chelating agents (for example, ethylenediaminetetraacetic acid or an alkali metal salt thereof, nitrilotriacetic acid or polyphosphoric acids), development accelerators (for example, compounds described in U.S. Pat. No. 2,394,025 and Japanese Patent Publication No. 47-45541), hardeners (for example, glutaraldehyde or an bisulfite adduct thereof) or anti-foaming agents. The pH of the developer is adjusted to be preferably 9.5 to 11.2, and more preferably 9.5 to 10.4.

As a particular case in which the developing agent is contained in the light sensitive material, for example, in the emulsion layer and the material is developed with an alkali solution, the compounds of the invention is incorporated in an activater processing solution. Such a development is often used as one of the rapid processes in combination with silver stabilizing treatment of a thiocyanate, and the compounds of the invention can be applied thereto. In such a rapid process, the invention exhibits remarkable effects.

A fixer having a conventional composition can be used. The fixer is usually an aqueous solution comprised of a fixing agent and other additives, and has a pH of 3.8 to 5.8. As the fixing agent can be used thiosulfates such as sodium thiosulfate, potassium thiosulfate or ammonium thiosulfate, thiocyanates such as sodium thiocyanate, potassium thiocyanate or ammonium thiocyanate, or organic sulfur compounds capable of producing soluble stable silver complexes.

To the fixer can be added water soluble alminium salts acting as a hardener such as alminium chloride, alminium sulfate and potash alum. To the fixer can be optionally added preservatives such as sulfites or metabisulfites, pH buffering agents (for example, acetic acid), pH regulators (for example, sulfuric acid) or chelating agents capable of softening hard water.

The developer may be a solution of a mixture of solid components, an organic solution containing glycol or amines or a solution obtained by diluting a viscous pasty liquid having a high viscosity. The temperature on development in the invention can be within a conventional range of 20° to 30° C., or within a higher range of 30° to 40° C.

The black-and-white silver halide photographic light-sensitive material in the invention is preferably processed using an automatic developing apparatus. On development the material is processed while replenising a specific amount of developer replenisher in proportion to the area of the material processed. The replenishing amount of the developer replenisher is not more than 250 ml per $m^2$ of the material processed in view of reducing waste solution, and preferably 75 to 200 ml per $m^2$ of the material processed. The replenishing amount less than 75 ml per $m^2$ of the material processed results in desensitizing and low contrast, and does not exhibit satisfactory results.

The developer replenisher may be different from the developer, for example in its composition or concentration. It is preferable that the developer replenisher is the same as the developer.

In the invention when using an automatic developing apparatus, the total processing time (Dry to Dry) is preferably 20–60 seconds. The total processing time is the time taken from the entry of the leading edge of a film in the apparatus to the derivery of the tail end of the film out of the drying zone of the apparatus. The total processing time referred to herein is a total time necessary to process a black-and-white silver halide photographic light-sensitive material, concretely the time necessary to carry out the staps such as developing, fixing, bleaching, washing, stabilizing and drying steps, that is, Dry to Dry time. The Dry to Dry time less than 20 seconds results in desensitizing and low contrast, and does not exhibit satisfactory results. The dry to dry time is more preferably 30 to 60 seconds.

EXAMPLES

The invention will be detailed in the following examples.

EXAMPLE 1

The subbed polyethylene terephthalate support was corona-charged at an energy of 8 W/$m^2$.min., and then coated with the following anti-static solution at a rate of 30m/min. using a roll-fit coating pan and an air knife to give the following coating amount.

(Preparation of a Support Having an Electroconductive Layer)

The subbed 100 μm thick polyethylene terephthalate support was corona-charged in an energy of 8 W/$m^2$.min., and then coated with the following anti-static solution at a rate of 70m/min. using a roll-fit coating pan and an air knife to give the following coating amount.

| | |
|---|---|
| Water-soluble conductive polymer P-6 | 0.6 g/$m^2$ |
| Hydrophobic polymer particles L-1 | 0.4 g/$m^2$ |
| Polyethylene oxide compound Ao-1 | 0.06 g/$m^2$ |
| Hardener E-8 | 0.2 g/$m^2$ |

The resulting material was dried at 90° C. for 2 minutes and subjected to heat treatment at 140° C. for 90 seconds. Thus, the support having a conductive layer on one side thereof was obtained.

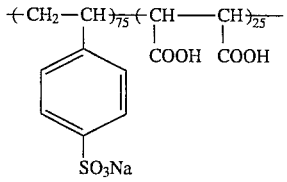

P-6 weight average molecular weight: 70,000

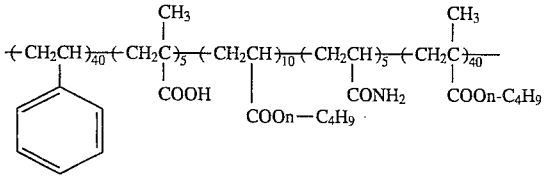

L-1

$HO(CH_2CH_2O)nH$ [n = 15] [Ao-1]

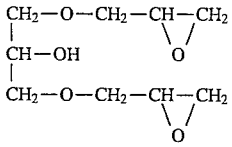

E-8

(Preparation of Silver Halide Emulsion)

A silver bromoiodochloride emulsion having a silver chloride content of 70 mol % and a silver iodide content of 0.2 mol % was prepared in a double-jet precipitation method. In the process from the time when 5% of the finally obtained average particle size of silver halide grains was formed till the time when the finally obtained average particle size of silver halide grains was formed, potassium hexabromo rhodate was added in an amount of $8.0\times10^{-5}$ mol/mol of silver.

The resulting emulsion was desalted with denatured gelatin treated with phenyl isocyanate using a conventional flocculation and redispersed in a gelatin solution. To the dispersion was added the following anti-mold agent [A], [B] and [C] in a total amount of 8 mg/g of gelatin. Thus, the monodispersed emulsion containing cubic silver halide grains (variation coefficient 10%) having an average grain size of 0.30 μm.

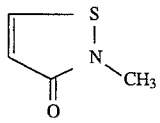

[A]

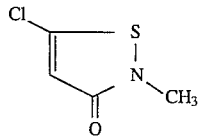

[B]

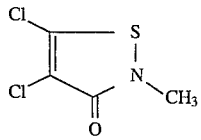

[C]

[A]:[B]:[C] = 46:50:4 (mol ratio)

To the emulsion was added citric acid, sodium chloride and 1-phenyl-2-mercaptotetrazole and then the resulting emulsion was chemically ripened with chloroauric acid and an inorganic sulfur at 60° C. to give the maximum sensitivity. Thereafter, 4-hydroxy-6-methyl-1,3,3*a*,7-tetrazaindene was added thereto in an amount of 1 g/mol of silver to stop the ripening and then 600 mg/mol of silver of potassium bromide and 150 mg/mol of silver of the following sensitizing dye SD- 1.

(Preparation of an Emulsion Coating Solution)

To the above obtained emulsion were added 4 g/mol of silver of hydroquinone, 15 g/mol of silver of the following latex polymer P-1, 150 mg/mol of silver of restrainer ST-1, 2 g/mol of silver of styrene-maleic acid copolymer (molecular weight: 70,000), 10 ml/mol of silver of a 1 N sodium hydroxide aqueous solution and 1.5 g/mol of silver of the following compound S-1. Thereafter, coating auxiliary saponin and 10 mg/g of gelation of hardener 2,4-dichloro-6-hydroxy- 1,3,5-triazine were added thereto.

(Preparation of an Emulsion Protective Coating Solution)

The emulsion protective coating solution was prepared to give coating amounts of 1.1 g/m$^2$ of gelatin, 1 mg/m$^2$ of a sodium sulfite-formaline adduct, 5.5 mg/m$^2$ of 1-phenyl-4-hydroxy- 3-pyrazolidone, 15 mg/m$^2$ of monodisperse silica having an average particle size of 3 μm, 15 mg/m$^2$ of monodisperse silica having an average particle size of 8 μm, 7 mg/m$^2$ of the following coating auxiliary S-2, 2 mg/m$^2$ of citric acid, 20 mg/m$^2$ of hardner formaline and $3\times10^{-6}$ mol/m$^2$ of a fluorine-containing surfactant FA-33.

(Preparation of a Backing Layer Coating Solution)

The backing layer coating solution was prepared to give coating amounts of 2.3 g/m$^2$ of gelatin, 100 mg/m$^2$ of the following soluble dye III-1, 25 mg/m$^2$ of the following soluble dye III-2, 100 mg/m$^2$ of the following soluble dye III-3, 350 mg/m$^2$ of latex polymer P-1, 60 mg/m$^2$ of styrene-maleic acid copolymer, 150 mg/m$^2$ of coloidal silica, 20 mg/m$^2$ of a mixture of compounds [A], [B] and [C], 9 mg/m$^2$ of coating auxiliary sodium dodecylbenzene sulfonate, 9 mg/m$^2$ of hardner glyoxal and 55 mg/m$^2$ of 2,4-dichloro-6-hydroxy-1,3,5-triazine.

S-2

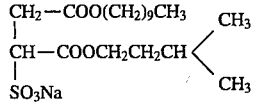

SD-1

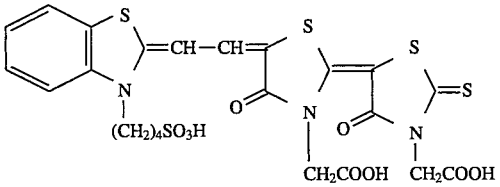

P-1

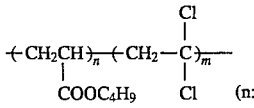

(n:m = 50:50)

-continued

ST-1

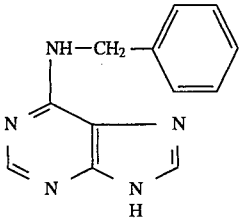

S-1

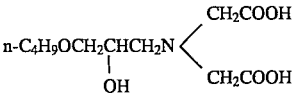

FA-33

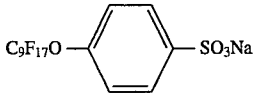

Compound III-1

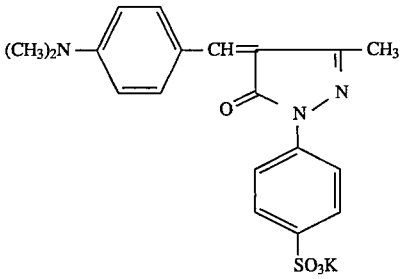

Compound III-2

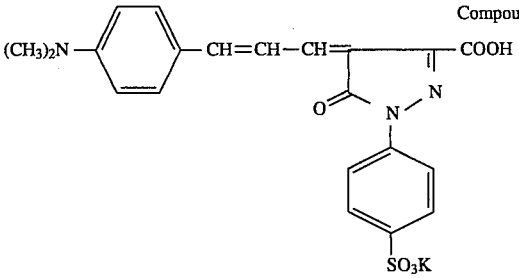

Compound III-3

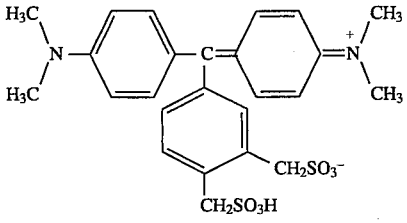

(Preparation of a Backing Protective Layer Coating Solution)

The backing protective layer coating solution was prepared to give coating amounts of 0.7 g/m$^2$ of gelatin, 7 mg/m$^2$ of S-2, 15 mg/m$^2$ of polymethyl methacrylate having an average particle size of 5.5 μm, 20 mg/m$^2$ of a mixture of compounds [A], [B] and [C], 40 mg/m$^2$ of styrene-maleic acid copolymer, 15 mg/m$^2$ of hardner glyoxal and 10 mg/m$^2$ of 2,4-dichloro- 6-hydroxy-1,3,5-triazine.

(Preparation of Silver Halide Photographic Light-sensitive Material Sample)

The above polyethlene terephthalate support having an anti-static layer was corona-charged at an energy of of 15 W/m$^2$.min., and then the above backing layer coating solution and backing protective layer coating solution were coated on the anti-static layer side. On the other side of the support corona-charged at an energy of of 15 W/m$^2$.min. the above emulsion solution and emulsion protective solution were coated to give coating amounts of 3.2 g/m$^2$ of silver and 1.7 g/m$^2$ of gelatin in the emulsion layer.

| Processing conditions (Developer Prescription) | |
|---|---|
| Disodium ethylenediamine tetraacetate | 2.0 g |
| Diethylene glycol | 25.0 g |
| Potassium sulfite | 37.8 g |
| Potassium carbonate | 55 g |
| Hydroquinone | 20 g |
| 5-methylbenzotriazole | 300 mg |
| 1-phenyl-5-mercaptotetrazole | 60 mg |
| Potassium hydroxide | amount necessary for the developer to be pH of 10.4 |
| Potassium bromide | 3.3 g |
| 1-phenyl-4-methyl-hydroxymethyl-3-pyrazolidone | 850 mg |
| Compounds represented by Formula [1] to [3] shown in Table 1 | 5 g |
| Compounds represented by Formula (4) and (5) shown in Table 1 | 150 mg |
| Add water to make | 1 liter |

The comparative sample was prepared, except that 18 g/liter of potassium sulfite was added to the developer instead of the compound represented by Formula (1) to (3).

<Storage Stability>

In a 1 liter beaker was placed 1 liter of each of the above prepared developers and it was stored at room temperature for a week Thereafter, the remained hydroquinone of the developer was measured.

(Photographic Property)

The above obtained sample was in close contact with a step wedge and exposed for $10^{-6}$ seconds using a 633 mm light through an interferance filter instead of He-Ne laser light. The exposed material was processed with the developer, which was stored for a week and fixer under the following conditions. Sensitometry was conducted. (The sensitivity was indicated by a sensitivity relative to sensitivity giving a density of 2.5 when the material was processed with the fresh comparative developer to be regarded as 100.)

| [Fixer Prescription] | |
|---|---|
| (Composition A) | |
| Ammonium thiosulfate (in an aqueous 72.5% W/V solution) | 230 ml |
| Sodium sulfite | 9.5 g |
| Sodium acetate trihydrate | 28 g |
| Boric acid | 6.7 g |
| Sodium citrate, dehydrate | 2 g |
| Acetic acid (aq. 90 weight % solution) | amount necessary for the fixer to be pH of 4.7 |
| (Composition B) | |
| Pure water | 17 ml |
| Sulfuric acid (in an aqueous 50% W/V solution) | 2.5 g |

-continued

| [Fixer Prescription] | |
|---|---|
| Aluminium sulfate (in an aqueous solution having a content of 8.1 W/W % converted into $Al_2O_3$) | 21 g |

When the fixer is prepared, the compositions A and B are dissolved in 500 ml water, and water is added thereto to make 1 liter (Development Process Conditions)

| Process | Temperature | Time |
|---|---|---|
| Development | 38° C. | 12 seconds |
| Fixing | 35° C. | 10 seconds |
| Washing | ordinary | 10 seconds |
| Drying | 50° C. | 13 seconds |
| Total time | | 45 seconds |

Each of the processing time includes a cross-over time.

The material was processed under the above conditions using an automatic developing machine (GQ-26SR produced by Konica Corporation). Thirty square meters of the unexposed sample were processed with the above developer and fixer in a developer replenishing amount of 160 cc/m$^2$ and in a fixer replenishing amount of 190 cc/m$^2$, using the automatic developing machine GQ-26SR (produced by Konica Corporation).

(Evaluation of Silver Stain)

In order to evaluate silver stain after processing, the unexposed 3.5×12 cm$^2$ sample was processed and observed for silver stain. The evaluation was conducted according to five evaluation criterions. The occurrence of most silver stain was defined as Rank 1, and no silver stain as Rank 5. The samples ranking less than 3 is not put into practical use.

(Photographic Property)

In order to examine photographic properties with minimal replenishment and rapid processing the sample was in close contact with a step wedge and exposed for $10^{-6}$ seconds using a 633 nm light through an interferance filter instead of He-Ne laser light. The exposed material was processed with the above processing solutions under the above conditions, and the developed sample was measured for sensitometry using PDA-65 (produced by Konica Corporation).

The results are shown in Table 1.

TABLE 1

| | | | After a week | | Continuous Processing | | |
|---|---|---|---|---|---|---|---|
| | | | Remaining | | | | |
| No. | [1]-[3] | [4] [5] | Rate of Hydro-quinone | Relative Sensiti-vity | Silver Stain | Relative Sensiti-vity | Remarks |
| 1 | — | — | 14 | 51 | 2 | 50 | Comparative |
| 2 | — | 4-3 | 17 | 52 | 3 | 51 | Comparative |
| 3 | 1-12 | — | 67 | 68 | 2 | 62 | Comparative |
| 4 | Potassium sulfite | 5-1 | 89 | 90 | 1 | 51 | Comparative |
| 5 | 1-12 | 5-2 | 91 | 80 | 4 | 72 | Inventive |
| 6 | 1-12 | 4-2 | 92 | 92 | 5 | 80 | Inventive |
| 7 | 1-12 | 4-15 | 91 | 88 | 5 | 77 | Inventive |
| 8 | 1-12 | 4-17 | 91 | 87 | 5 | 75 | Inventive |
| 9 | 2-4 | 5-7 | 93 | 79 | 4 | 70 | Inventive |
| 10 | 2-4 | 4-17 | 93 | 90 | 5 | 81 | Inventive |
| 11 | 2-4 | 4-21 | 92 | 90 | 5 | 82 | Inventive |
| 12 | 3-6 | 4-2 | 89 | 90 | 5 | 82 | Inventive |
| 13 | 3-6 | 4-15 | 88 | 87 | 4 | 76 | Inventive |
| 14 | 3-6 | 4-21 | 87 | 86 | 4 | 75 | Inventive |
| 15 | 1-8 | 4-15 | 90 | 90 | 5 | 81 | Inventive |
| 16 | 1-8 | 5-2 | 90 | 81 | 4 | 76 | Inventive |

As is apparent from Table 1, the developer of the invention exhibits less silver stain and excellent aging stability of development.

EXAMPLE 2

(Preparation of Silver Halide Emulsion)

The silver halide emulsion was prepared in the same manner as in Example 1.

(Preparation of Silver Halide Photographic Light-sensitive Material Sample)

On the one side of a 100 μm thick polyethlene terephthalate support on which a 0.1 μm thick subbing layer was provided in the same manner as in Example 1 of U.S. Pat. No. 4,571,379 was coated an emulsion layer to give coating amounts of 3.2 g/m$^2$ of silver and 2.0 g/m$^2$ of gelatin. The emulsion layer was prepared as the following prescription (1) using the silver halide emulsion prepared in Example 1. The emulsion protective solution in Example 1 was further coated on the emulsion layer-corona charged at an energy of of 15 W/m$^2$.min., and then the above backing layer coating solution and backing protective layer coating solution were coated on the anti-static layer side. On the other side of the support corona-charged at an energy of of 15 W/m$^2$.min.

| Prescription (1) | |
|---|---|
| Hydroquinone | 4 g/mol of Ag |
| P-1 | 15 g/mol of Ag |
| ST-1 | 150 mg/mol of Ag |
| Styrene-maleic acid copolymer (average molecular weight: 70,000) | 2 g/mol of Ag |
| S-1 | 1.5 g/mol of Ag |
| Sensitizing dye | |
| 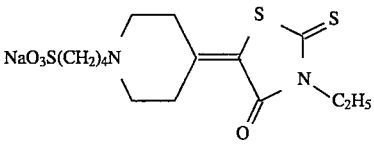 | 2.2 mg/m$^2$ |
| 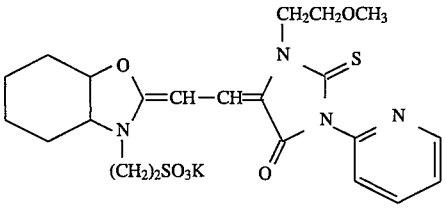 | 7.8 mg/m$^2$ |
| Stabilizer 4-methyl-6-hydroxy- | 30 mg/m$^2$ |

-continued

| Prescription (1) | |
|---|---|
| 1,3,3a,7-tetrazaindene | |
| Hardener 2,4-dichloro-6-hydroxy-1,3,5-triazine sodium salt | 10 mg/m$^2$ |
| Anti-foggant adenine-1-phenyl-5-mercaptotetrazole | 5 mg/m$^2$ |
| Surfactant saponin | 0.1 g/m$^2$ |
| S-1 | |
| $CH_2COO(CH_2)_9CH_3$ / $CHCOO(CH_2)_2CH$ ($CH_3$, $CH_3$) / $SO_3Na$ | 8 mg/m$^2$ |
| Nuclear promoting agent (Na-9) | 500 mg/m$^2$ |
| Hydrazine derivative (H-12) | $2 \times 10^{-3}$ mol/mol of Ag |

The evaluations of storage stability, photographic property and silver stain were conducted in the same manner as in Example 1. The developer was the same as Example 1, except that the compounds of the invention represented by Formula (1), (2) or (3) and the compounds of the invention represented by Formula (4) or (5) as shown in Table 2 were used. The results are shown in Table 2.

TABLE 2

| No. | Compounds represented by Formulas [1] to [3] | Compounds represented by Formulas Formulas [4] and [5] | Hydrazine Derivative | After a week: Remaining: Rate of Hydro-quinone | After a week: Relative Sensi-tivity | Continuous Processing: Silver Stain | Continuous Processing: Relative Sensi-tivity | Continuous Processing: Gamma | Continuous Processing: Black Spots | Remarks |
|---|---|---|---|---|---|---|---|---|---|---|
| 1 | — | — | H-12 | 13 | 51 | 1 | 48 | 6.2 | 1 | Comparative |
| 2 | — | 4-2 | H-12 | 17 | 50 | 2 | 47 | 9.4 | 3 | Comparative |
| 3 | 1-12 | — | H-12 | 58 | 69 | 2 | 66 | 7.5 | 1 | Comparative |
| 4 | Potassium sulfite | 5-1 | H-12 | 88 | 88 | 1 | 88 | 15.0 | 1 | Comparative |
| 5 | 1-12 | 4-2 | H-12 | 90 | 93 | 5 | 91 | 17.1 | 5 | Inventive |
| 6 | 1-12 | 4-15 | H-12 | 90 | 89 | 5 | 87 | 16.5 | 4 | Inventive |
| 7 | 1-12 | 4-17 | H-12 | 90 | 90 | 5 | 90 | 17.0 | 5 | Inventive |
| 8 | 1-12 | 5-7 | H-12 | 87 | 77 | 3 | 72 | 15.0 | 4 | Inventive |
| 9 | — | — | H-14 | 15 | 60 | 1 | 50 | 8.0 | 1 | Comparative |
| 10 | — | 4-2 | H-14 | 20 | 68 | 2 | 55 | 8.1 | 2 | Comparative |
| 11 | 2-6 | 4-15 | H-14 | 92 | 92 | 5 | 90 | 16.8 | 5 | Inventive |
| 12 | 2-6 | 4-17 | H-14 | 91 | 93 | 5 | 90 | 17.5 | 5 | Inventive |
| 13 | 2-6 | 4-20 | H-14 | 90 | 91 | 5 | 90 | 17.0 | 5 | Inventive |
| 14 | 3-6 | 4-21 | H-14 | 86 | 91 | 5 | 89 | 16.9 | 5 | Inventive |
| 15 | 3-6 | 5-2 | H-14 | 86 | 78 | 4 | 71 | 15.1 | 4 | Inventive |

As apparent from Table 2, the sample of the invention exhibits excellent aging stability, less silver stain, less black spots and no lowering of contrast.

What is claimed is:

1. A method of processing an exposed silver halide photographic light-sensitive material comprising a support and provided thereon, a silver halide emulsion layer and a hydrophilic colloid layer other than the silver halide emulsion layer using an automatic developing apparatus, comprising the steps of:

a) developing the exposed material with developer, the developer being replenished with not more than 250 ml of developer replenisher per m$^2$ of said material;

b) fixing the developed material with fixer;

c) washing the fixed material; and d) drying the washed material, wherein the developer contains a compound represented by the following Formula (1a), (1b), (2) or (3) and a compound represented by the following Formula (4) or (5):

Formula (1a)

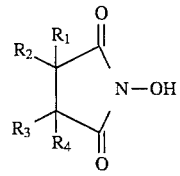

Formula (1b)

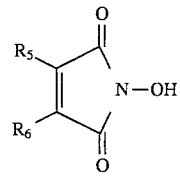

wherein $R_1$ through $_6$ independently represent a hydrogen atom, an unsubstituted alkyl group, —$CH_2CH_2OH$, an unsubstituted aryl group, an allyl group, a hydroxy group, a carboxy group, a sulfo group, a nitro group, a halogen atom, a hydroxyamino group, an unsubstituted alkoxyl group, an unsubstituted amino group, or an unsubstituted carbamoyl group, provided that $R_2$ and $R_3$, and $R_5$ and $R_6$ may combine with each other to form a saturated or unsaturated ring;

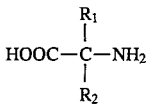

Formula (2)

wherein $R_1$ and $R_2$ independently represent a hydrogen atom, an unsubstituted alkyl group, $—CH_2CH_2OH$, $—(CH_2)_3OH$, p-hydroxybenzyl, $—(CH_2)_4NH_2$, an unsubstituted aryl group, p-hydroxyphenyl, p-methyl phenyl, an unsubstituted allyl group, $—CH_2CH=CHCH_3$, a carboxy group, a hydroxy group, a sulfo group, a nitro group, a cyano group, a halogen atom, a hydroxyamino group, an unsubstituted alkoxy group, an unsubstituted amino group, or an unsubstituted carbamoyl group;

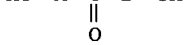

Formula (3)

wherein A and B independently represent an unsubstituted alkylene group, an unsubstituted alkenylene group, an unsubstituted alkyleneoxy group, an unsubstituted arylene group, a sulfonyl group, —R—C(O)—, or —R—NH—, wherein R represents an unsubstituted alkylene, alkenylene or arylene group, provided that A and B may be the same or different;

Formula (4)

Z—SM wherein Z represents an alkyl, aromatic, or heterocyclic group, or an alkyl, aromatic, or heterocyclic group having at least one substituent selected from the group consisting of a hydroxy group, an $—SO_3M^1$ group, a $—COOM^1$ group, wherein $M^1$ represents a hydrogen atom, an alkali-metal atom, unsubstituted ammonium, an unsubstituted amino group, and an unsubstituted ammonio group; and M represents a hydrogen atom, an alkali-metal atom, or unsubstituted ammonium;

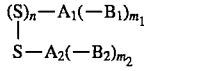

Formula (5)

wherein $A_1$ and $A_2$ independently represent an unsubstituted alkylene, cycloalkylene, aralkylene, arylene, divalent 5- or 6-membered heterocyclic group, $—CH(CH_3)CH_2CH_2—$, $—C(CH_3)_2—$, $—CH_2CH(C_6C_5)—$, $—CH_2CH(p—NH_2SO_2C_6H_5)—$, $—CH(CH_3)—$,

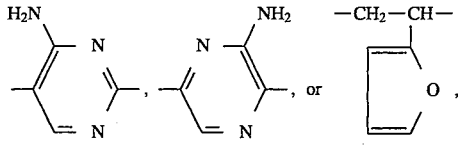

$m_1$ and $m_2$ independently represent an integer of 1, 2, or 3; n is 1 or 2; and $B_1$ and $B_2$ independently represent —COOM, $—SO_3M^1$, —CON(X)(Y), $—S—Z^1$, or $—SO_2N(X)(Y)$, wherein X and Y independently represent a hydrogen atom, an alkyl group having 1–8 carbon atoms, or an aryl group each of which may include a hydroxyl group, a carboxyl group, or a sulfonic acid group, M and $M^1$ independently represent a hydrogen atom or an alkali metal atom, and $Z^1$ is the same as X or Y, provided that $Z^1$ is not a hydrogen atom.

2. The method of claim 1, wherein the developer contains said compound represented by said Formula (1a) or (1b).

3. The method of claim 1, wherein the developer contains said compound represented by said Formula (2).

4. The method of claim 1, wherein the developer contains said compound represented by said Formula (3).

5. The method of claim 1, wherein the developer contains said compound represented by said Formula (4).

6. The method of claim 1 wherein, in Formula (1a) or (1b), $R_1$ through $R_6$ independently represent a hydrogen atom, an unsubstituted alkyl group, $—CH_2CH_2OH$, a hydroxy group, or a carboxy group, provided that $R_5$ and $R_6$ may combine with each other to form a saturated or unsaturated ring.

7. The method of claim 1 wherein, in Formula (2), $R_1$ and $R_2$ independently represent a hydrogen atom, an unsubstituted alkyl group, $—CH_2CH_2OH$, $—(CH_2)_3OH$, p-hydroxylbenzyl, $—(CH_2)NH_2$, a hydroxy group, a carboxy group, or an amino group.

8. The method of claim 1 wherein A and B independently represent unsubstituted alkyleneoxy group, —R—C(O)—, or —R—NH—, wherein R represents an unsubstituted alkylene, alkenylene, or arylene group.

9. The method of claim 1, wherein one of the silver halide emulsion layer and the hydrophilic colloid layer other than the silver halide emulsion layer contains a hydrazine derivative and a nuclear promoting agent, and the developer has a pH of not more than 10.4.

10. The method of claim 1, wherein the total processing time is 20–60 seconds.

11. The method of claim 1, wherein the fixer is replenished with fixer replenisher in an amount of not more than 250 ml per $m^2$ of the material processed.

* * * * *